US008762146B2

(12) United States Patent
Geyzel

(10) Patent No.: US 8,762,146 B2
(45) Date of Patent: Jun. 24, 2014

(54) AUDIO WATERMARKING

(75) Inventor: Zeev Geyzel, Tekoa (IL)

(73) Assignee: Cisco Technology Inc., San Jose, CA (US)

( * ) Notice: Subject to any disclaimer, the term of this patent is extended or adjusted under 35 U.S.C. 154(b) by 0 days.

(21) Appl. No.: 14/003,994

(22) PCT Filed: Jun. 11, 2012

(86) PCT No.: PCT/IB2012/052937

§ 371 (c)(1),
(2), (4) Date: Sep. 23, 2013

(87) PCT Pub. No.: WO2013/017966

PCT Pub. Date: Feb. 7, 2013

(65) Prior Publication Data

US 2014/0039903 A1 Feb. 6, 2014

Related U.S. Application Data

(60) Provisional application No. 61/574,440, filed on Aug. 3, 2011.

(51) Int. Cl.
*G10L 15/26* (2006.01)

(52) U.S. Cl.
USPC ..... 704/235; 84/600; 713/176; 713/167; 704/500; 704/273; 704/231; 700/94; 382/100; 380/252; 380/235; 378/154; 375/133; 358/3.2

(58) Field of Classification Search
USPC ..... 84/600; 713/176, 167; 704/500, 273, 704/231; 700/94; 382/100; 380/252, 235; 378/154; 375/133; 358/3.2
See application file for complete search history.

(56) References Cited

U.S. PATENT DOCUMENTS 6,209,094 B1 * 3/2001 Levine et al. ..... 713/176
6,571,144 B1 5/2003 Moses et al.

(Continued)

FOREIGN PATENT DOCUMENTS

JP 2005049409 A 2/2005
JP 2009077331 A * 4/2009
KR 20090093530 A 9/2009

OTHER PUBLICATIONS

Sep. 28, 2012 Transmittal of International Search Report and Written Opinion of the International Searching Authority for PCT/IB2012/052937.

*Primary Examiner* — Michael Colucci
(74) *Attorney, Agent, or Firm* — Husch Blackwell LLP

(57) ABSTRACT

A system, including a processor to define opportunities for encoding a watermark into an audio stream having sections, each section, when represented in the frequency domain, including a signal of amplitude against frequency, the processor being operative to, for each one of the sections, identify a fundamental frequency, f being the frequency with the largest amplitude of the signal in the one section, the fundamental frequency f defining harmonic frequencies, each harmonic frequency being at a frequency f/2n or 2fn, n being a positive integer, and define the one section as an opportunity for encoding at least part of the watermark if the amplitude of the signal of the one section is less than a value v for all frequencies in one or more different frequency ranges, each of the different frequency ranges being centered around different ones of the harmonic frequencies. Related apparatus and methods are also described.

11 Claims, 3 Drawing Sheets

(56) References Cited

U.S. PATENT DOCUMENTS

| | | | | |
|---|---|---|---|---|
| 6,674,873 | B1 * | 1/2004 | Donescu et al. | 382/100 |
| 7,006,555 | B1 * | 2/2006 | Srinivasan | 375/133 |
| 7,248,934 | B1 * | 7/2007 | Rossum et al. | 700/94 |
| 7,289,961 | B2 * | 10/2007 | Bocko et al. | 704/273 |
| 7,304,227 | B2 * | 12/2007 | Hoguchi | 84/600 |
| 7,325,131 | B2 * | 1/2008 | Reefman | 713/167 |
| 7,395,211 | B2 * | 7/2008 | Watson et al. | 704/500 |
| 7,467,021 | B2 * | 12/2008 | Yuen et al. | 700/94 |
| 7,532,740 | B2 | 5/2009 | Levy | |
| 7,565,296 | B2 * | 7/2009 | Oh | 704/273 |
| 8,055,505 | B2 * | 11/2011 | Tachibana et al. | 704/273 |
| 8,300,820 | B2 * | 10/2012 | Rhein | 380/252 |
| 8,527,268 | B2 * | 9/2013 | Quan | 704/231 |
| 2002/0168069 | A1 * | 11/2002 | Tehranchi et al. | 380/235 |
| 2002/0196901 | A1 * | 12/2002 | Inoue | 378/154 |
| 2005/0129270 | A1 * | 6/2005 | Prakash | 382/100 |
| 2006/0048633 | A1 * | 3/2006 | Hoguchi | 84/600 |
| 2006/0239501 | A1 | 10/2006 | Petrovic et al. | |
| 2009/0192805 | A1 | 7/2009 | Topchy et al. | |
| 2009/0213430 | A1 * | 8/2009 | Wang | 358/3.2 |
| 2010/0017201 | A1 | 1/2010 | Tanaka et al. | |

* cited by examiner

| 38 → Section | 1 | 2 | 3 | 4 | 5 | 6 | 7 | 8 | 9 | 10 | 11 | 12 |
|---|---|---|---|---|---|---|---|---|---|---|---|---|
| Opportunity | ✓ | ✗ | ✗ | ✓ | ✓ | ✓ | ✗ | ✗ | ✗ | ✓ | ✗ | ✓ |
| Increase harmonic | ✓ | - | - | ✗ | ✓ | ✓ | - | - | - | ✗ | - | ✓ |
| Encoding | 1 | - | - | 0 | 1 | 1 | - | - | - | 0 | - | 1 |

| | Pair 1 | | | | Pair 2 | | | Pair 3 | | Pair 4 | | |
|---|---|---|---|---|---|---|---|---|---|---|---|---|
| 38 → Section | 1 | 2 | 3 | 4 | 5 | 6 | 7 | 8 | 9 | 10 | 11 | 12 |
| Opportunity | ✓ | ✗ | ✗ | ✓ | ✓ | ✓ | ✗ | ✓ | ✓ | ✓ | ✗ | ✓ |
| Increase harmonic | ✓ | - | - | ✗ | ✓ | ✓ | - | ✗ | ✓ | ✗ | - | ✗ |
| Encoding | 1 | | | | Invalid | | | 0 | | No encoding | | |

AUDIO WATERMARKING

RELATED APPLICATION INFORMATION

The present application is a 35 USC §371 application of PCT/IB2012/052937, filed on 11 Jun. 2012 and entitled "Audio Watermarking", which was published on 7 Feb. 2013 in the English language with International Publication Number WO 2013/017966 and which relies for priority on U.S. Provisional Patent Application Ser. No. 61/574,440 of Geyzel filed 3 Aug. 2011.

FIELD OF THE INVENTION

The present invention relates to audio watermarking.

BACKGROUND OF THE INVENTION

By way of introduction, watermarking may be used to detect illegally distributed content and to determine the origin of the illegal distribution.

The following references are believed to represent the state of the art:

US Published Patent Application 2006/0048633 of Hoguchi;

US Published Patent Application 2006/0239501 of Petrovic, et al.;

Japanese Published Patent Application 2005 049409 of University of Meiji; and

Korean Published Patent Application 2009 0093530 of University of Seoul Industry Cooperation Foundation.

SUMMARY OF THE INVENTION

The present invention, in certain embodiments thereof, seeks to provide an improved audio watermarking system.

By way of introduction, when a note is played simultaneously in two octaves, the two notes sound basically the same to most listeners. The same note in the next (higher) octave is twice the frequency of the current note, in the previous (lower) octave, half the frequency of the current note. A harmonic is the same note in different octaves.

The present invention, in embodiments thereof, includes a watermarking system for encoding watermark data in, or close to, one or more harmonic frequencies of different sections of an audio content item so that the embedded audio watermark is less disturbing to the ear of the listener.

In particular, the watermarking system includes identifying suitable encoding opportunities for encoding the audio watermark in the audio content by analyzing constituent frequencies of various sections of the audio content.

There is thus provided in accordance with an embodiment of the present invention a system, including a processor to define a plurality of opportunities for encoding a watermark into an audio stream, the audio stream having a plurality of sections, each of the sections, when represented in the frequency domain, including a signal of amplitude against frequency, the processor being operative to, for each one of the sections of the audio stream identify a fundamental frequency, f, of the one section, the fundamental frequency being the frequency with the largest amplitude of the signal in the one section, the fundamental frequency f defining a plurality of harmonic frequencies, each of the harmonic frequencies being at a frequency f/2n or 2fn, n being a positive integer, and define the one section as an opportunity for encoding at least part of the watermark if the amplitude of the signal of the one section is less than a value v for all frequencies in one or more of a plurality of different frequency ranges, each of the different frequency ranges being centered around different ones of the harmonic frequencies.

Further in accordance with an embodiment of the present invention, the value v is less than, or equal to, 25% of the amplitude of the signal at the fundamental frequency of the one section.

Still further in accordance with an embodiment of the present invention, the size of each of the different frequency ranges is equal to 6% of the frequency at the center of each of the different frequency ranges, respectively.

Additionally in accordance with an embodiment of the present invention, the harmonic frequencies are within a range of frequencies from 20 Hertz to 20,000 Hertz.

Moreover in accordance with an embodiment of the present invention, the processor is operative to prepare data for transmission to another device, the data including the audio stream formatted in the frequency domain or in the time domain, and information identifying the defined opportunities.

Further in accordance with an embodiment of the present invention, the system includes transmission equipment to transmit the data to the other device.

Still further in accordance with an embodiment of the present invention, the processor is operative to prepare the data to include, for each one of the sections of the audio stream defined as one of the opportunities timing information of the one section, the amplitude of the signal at the fundamental frequency of the one section, the one or more different ones of the harmonic frequencies of the one section.

Additionally in accordance with an embodiment of the present invention, the processor is operative to prepare the data to include data defining pairs of the sections which have been defined as one of the opportunities for encoding the watermark.

Moreover in accordance with an embodiment of the present invention, the system includes a watermark encoder to encode the watermark into the audio stream, the encoding including adding audio to at least some of the sections defined as the encoding opportunities, the added audio being added such that for each one of the defined sections, the added audio is added somewhere in each of the different frequency ranges, or in one of the different frequency ranges.

Further in accordance with an embodiment of the present invention, the added audio has a maximum amplitude equal to 25% of the amplitude of the signal at the fundamental frequency of the one section.

There is also provided in accordance with still another embodiment of the present invention, a method, including defining a plurality of opportunities for encoding a watermark into an audio stream, the audio stream having a plurality of sections, each of the sections, when represented in the frequency domain, including a signal of amplitude against frequency, and for each one of the sections of the audio stream identifying a fundamental frequency, f, of the one section, the fundamental frequency being the frequency with the largest amplitude of the signal in the one section, the fundamental frequency f defining a plurality of harmonic frequencies, each of the harmonic frequencies being at a frequency f/2n or 2fn, n being a positive integer, and defining the one section as an opportunity for encoding at least part of the watermark if the amplitude of the signal of the one section is less than a value v for all frequencies in one or more of a plurality of different frequency ranges, each of the different frequency ranges being centered around different ones of the harmonic frequencies.

BRIEF DESCRIPTION OF THE DRAWINGS

The present invention will be understood and appreciated more fully from the following detailed description, taken in conjunction with the drawings in which.

DETAILED DESCRIPTION OF AN EMBODIMENT

Figure 1:
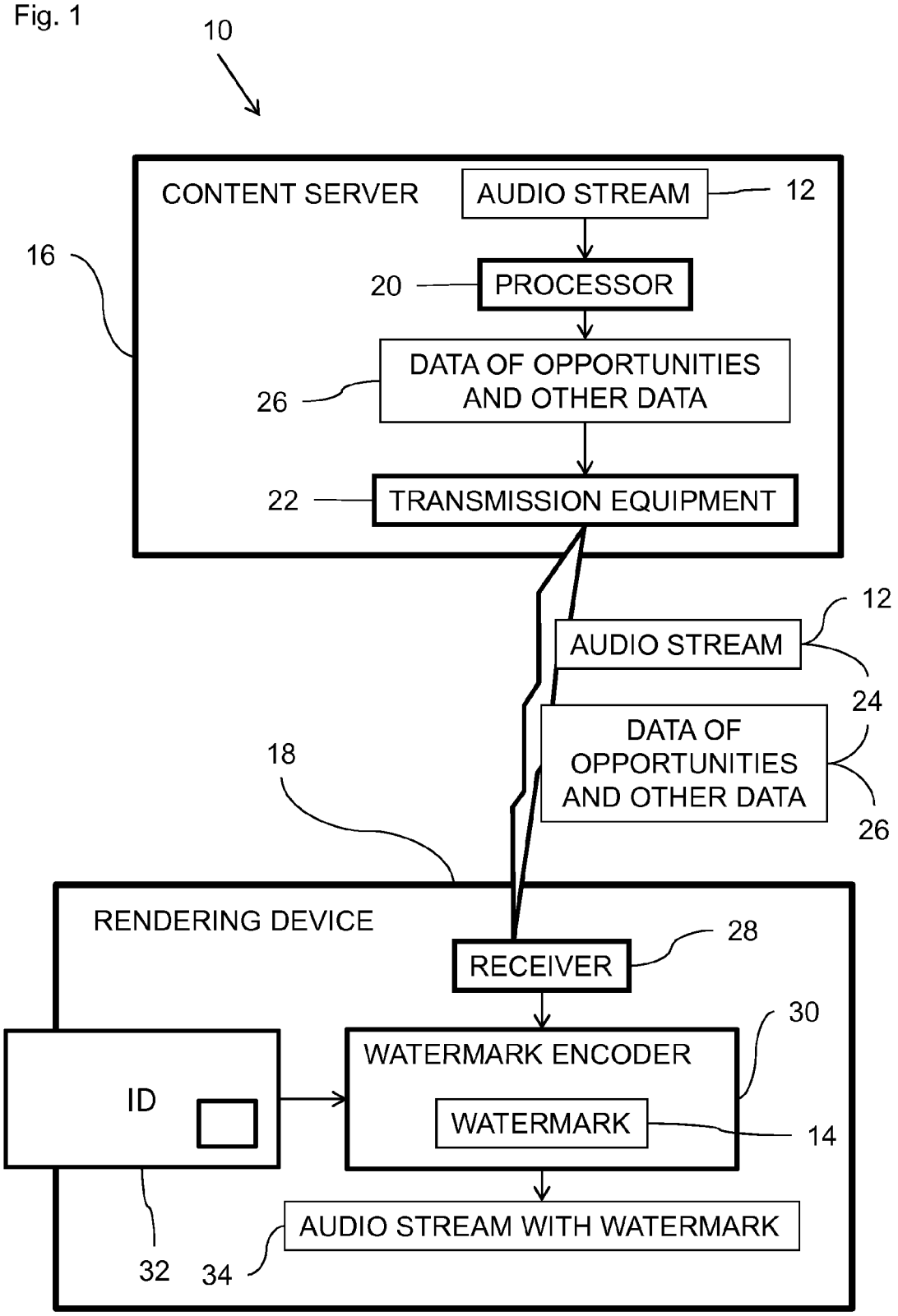
FIG. 1 is a partly pictorial, partly block diagram view of a watermarking system constructed and operative in accordance with an embodiment of the present invention.

The term "encoded" is used throughout the present specification and claims, in all of its grammatical forms, to refer to any type of data stream encoding including, for example and without limiting the scope of the definition, well known types of encoding such as, but not limited to, MPEG-2 encoding, H.264 encoding, VC-1 encoding, and synthetic encodings such as Scalable Vector Graphics (SVG) and LASER (ISO/IEC 14496-20), and so forth. It is appreciated that an encoded data stream generally requires more processing and typically more time to read than a data stream which is not encoded. Any recipient of encoded data, whether or not the recipient of the encoded data is the intended recipient, is, at least in potential, able to read encoded data without requiring cryptanalysis. It is appreciated that encoding may be performed in several stages and may include a number of different processes, including, but not necessarily limited to: compressing the data; transforming the data into other forms; and making the data more robust (for instance replicating the data or using error correction mechanisms).

The term "compressed" is used throughout the present specification and claims, in all of its grammatical forms, to refer to any type of data stream compression. Compression is typically a part of encoding and may include image compression and motion compensation. Typically, compression of data reduces the number of bits comprising the data. In that compression is a subset of encoding, the terms "encoded" and "compressed", in all of their grammatical forms, are often used interchangeably throughout the present specification and claims.

Similarly, the terms "decoded" and "decompressed" are used throughout the present specification and claims, in all their grammatical forms, to refer to the reverse of "encoded" and "compressed" in all their grammatical forms.

The terms "scrambled" and "encrypted", in all of their grammatical forms, are used interchangeably throughout the present specification and claims to refer to any appropriate scrambling and/or encryption methods for scrambling and/or encrypting a data stream, and/or any other appropriate method for intending to make a data stream unintelligible except to an intended recipient(s) thereof. Well known types of scrambling or encrypting include, but are not limited to DES, 3DES, and AES. Similarly, the terms "descrambled" and "decrypted" are used throughout the present specification and claims, in all their grammatical forms, to refer to the reverse of "scrambled" and "encrypted" in all their grammatical forms.

Pursuant to the above definitions, the terms "encoded"; "compressed"; and the terms "scrambled" and "encrypted" are used to refer to different and exclusive types of processing. Thus, a particular data stream may be, for example:

encoded, but neither scrambled nor encrypted;
compressed, but neither scrambled nor encrypted;
scrambled or encrypted, but not encoded;
scrambled or encrypted, but not compressed;
encoded, and scrambled or encrypted; or
compressed, and scrambled or encrypted.

Likewise, the terms "decoded" and "decompressed" on the one hand, and the terms "descrambled" and "decrypted" on the other hand, are used to refer to different and exclusive types of processing.

Reference is now made to FIG. 1, which is a partly pictorial, partly block diagram view of a watermarking system 10 constructed and operative in accordance with an embodiment of the present invention.

By way of introduction, when a note is played simultaneously in two octaves, the two notes sound basically the same to most listeners. The same note in the next (higher) octave is twice the frequency of the current note, in the previous (lower) octave, half the frequency of the current note. A harmonic is the same note in different octaves.

The watermarking system 10 is operative to take advantage of the similarity between different sounds for encoding watermark data 14 in, or close to, one or more harmonic frequencies of different sections of an audio stream 12 so that the embedded audio watermark is less disturbing to the ear of the listener.

In particular, the watermarking system 10 includes identifying suitable encoding opportunities for encoding the audio watermark 14 in the audio stream 12 by analyzing constituent frequencies of various sections of the audio stream 12.

The watermarking system 10 will now be described in more detail.

The watermarking system 10 typically includes a content server 16 and a plurality of rendering devices 18 (only one shown for the sake of simplicity).

The content server 16 typically includes a processor 20 and transmission equipment 22.

The processor 20 is typically operative to define a plurality of opportunities for encoding the watermark 14 into the audio stream 12. The opportunities identify which sections of the audio stream 12 are suitable for encoding the watermark 14 therein. The processor 20 is typically operative to prepare data 24 for transmission to the rendering devices 18. The data 24 typically includes the audio stream 12 formatted in the frequency domain or in the time domain and information identifying the defined opportunities 26. The information identifying the defined opportunities 26 is described in more detail with reference to FIG. 2.

The transmission equipment 22 is typically operative to transmit the data 24 to the rendering devices 18. The data 24 may be transmitted using any suitable communication method, for example, but not limited to, satellite, cable, Internet Protocol, terrestrial or cellular communication systems or any suitable combination thereof.

Each rendering device 18 typically includes a receiver 28 and a watermark encoder 30. Each rendering device 18 may also include other suitable elements, for example, but not limited to, a content player and suitable drivers. The rendering devices 18 may be selected from any suitable rendering device, for example, but not limited to, a set-top box, a suitably configured computer and a mobile device.

The receiver 28 is typically operative to receive the data 24 from the content server 16.

Each rendering device 18 is typically associated with an identification 32 identifying the rendering device 18 and/or the subscriber/user of the rendering device 18. The identification 32 may be partially or wholly disposed in a secure chip such as a SIM card or smart card which may be disposed in the rendering device 18 or removable inserted into the rendering device 18. The watermark encoder 30 is typically operative to define the watermark data 14 such that at least part of the watermark data 14 is typically based on at least part of the identification 32. At least some of the identification 32 may be hashed, using any suitable cryptographic hash, as part of the process of forming the watermark data 14 by the watermark encoder 30.

The watermark encoder 30 is typically operative to encode the watermark 14 into the audio stream 12 based on the received information 26 identifying the defined opportunities (block 34). In other words, the watermark data 14 is encoded only in those sections of the audio stream 12 defined as encoding opportunities.

FIG. 1 shows the processor 20 defining the opportunities and the transmission equipment 22 sending the information identifying the defined opportunities 26 to the rendering devices 18 for encoding.

Defining the opportunities in the content server 16 and encoding the audio stream 12 in the rendering devices 18 is advantageous for at least the following reasons. First, the rendering devices 18 may not have the required processing power to define the opportunities. Second, identifying the opportunities at the content server 16 may improve subsequent identification of the watermark data 14, even in noisy environments, as the location of the opportunities is already known by the content server 16.

It will be appreciated by those ordinarily skilled in the art that the opportunities could be defined and the watermark data 14 encoded in the rendering devices 18, if necessary.

Figure 2:
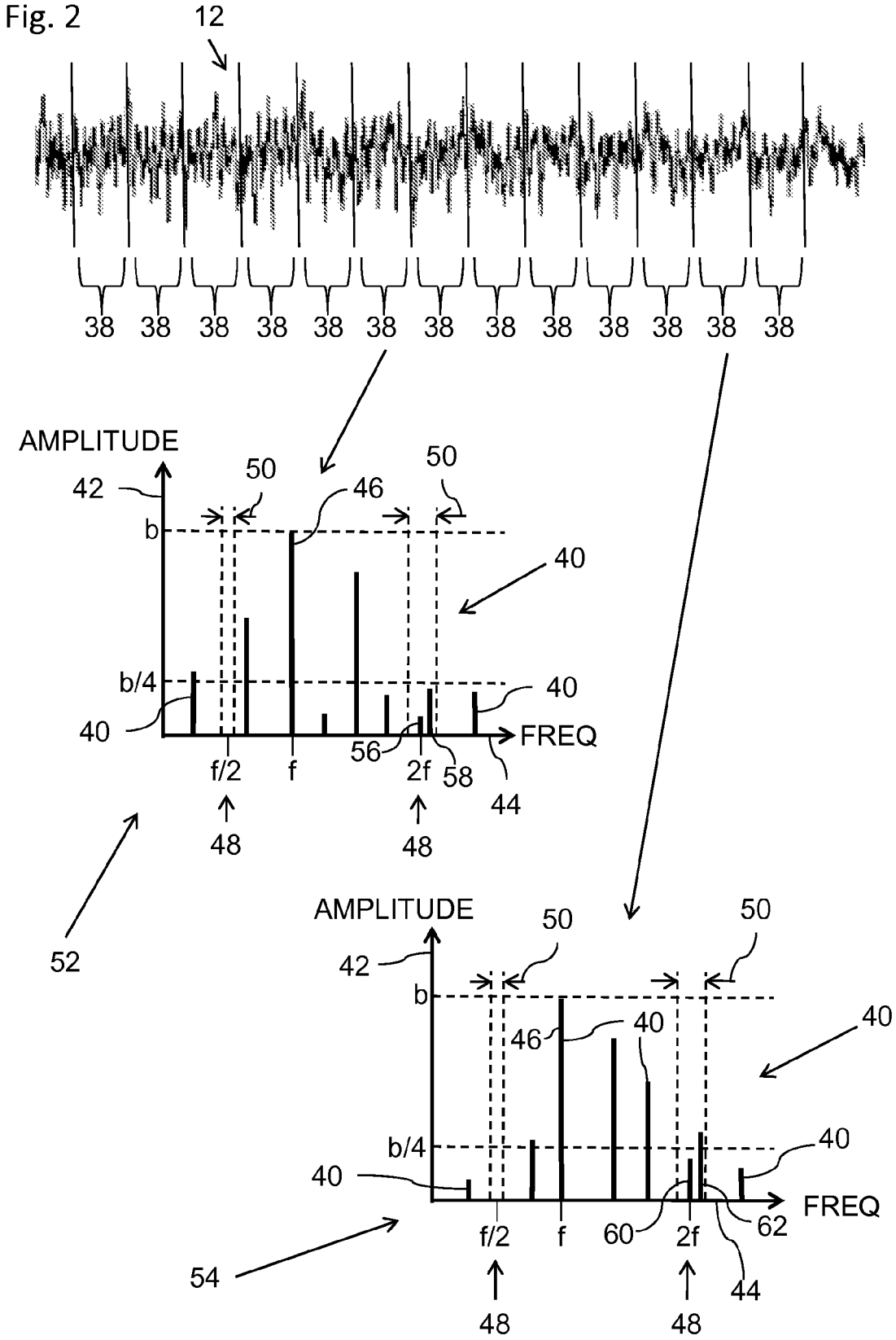
FIG. 2 is a view showing identification of watermarking encoding opportunities in the system of FIG. 1.

Reference is now made to FIG. 2, which is a view showing identification of watermark encoding opportunities in the system 10 of FIG. 1.

The audio stream 12 has a plurality of sections 38, for example, but not limited to, audio frames. Each section 38, when represented in the frequency domain, includes a signal 40 of amplitude 42 against frequency 44. The signal 40 is shown in FIG. 2 as a series of vertical lines which are the thickest lines in FIG. 2. Only some of the vertical lines of the signal 40 have been labeled for the sake of simplicity. Each section 38 may have any suitable duration, for example, but not limited to, between 30 milliseconds and 100 milliseconds.

If the audio stream 12 is not already divided into the sections 38 by the time it reaches the processor 20 (FIG. 1), the processor 20 is typically operative to divide the audio stream 12 into the sections 38.

Similarly, if the audio stream 12 is not represented in the frequency domain, the processor 20 (FIG. 1) performs a transform, such as a Fourier Transform, in order to yield the frequency domain representation of each section 38 of the audio stream 12.

It should be noted that MPEG encoded audio is typically encoded as Fourier transforms of the sections 38 and therefore analyzing MPEG audio frames for suitable encoding opportunities, in general, requires less processing.

The processor 20 (FIG. 1) is operative to analyze the frequency domain representations of the sections 38 in order to identify good candidates for encoding the watermark data 14 (FIG. 1).

Defining the encoding opportunities is now described in more detail.

The processor 20 (FIG. 1) is typically operative to identify a fundamental frequency 46, f, for each section 38 of the audio stream 12. The fundamental frequency 46 of each section 38 is the frequency with the largest amplitude of the signal 40. The fundamental frequency f of each section 38 defines a plurality of harmonic frequencies 48. Each harmonic frequency 48 is at a frequency f/2n or 2fn, n being a positive integer. The harmonic frequencies 48 are typically within a range of frequencies from 20 Hertz to 20,000 Hertz.

The processor 20 (FIG. 1) is typically operative to define any section 38 as an opportunity for encoding at least part of the watermark 14 (FIG. 1) if the amplitude of the signal 40 of that section 38 is less than a value v for all frequencies in one or more of a plurality of different frequency ranges 50. Each different frequency range 50 is centered around a different harmonic frequency 48 of that section 38. So for example, one of the frequency ranges 50 may be centered around f/2 and another of the frequency ranges 50 may be centered around 2f.

The watermark data 14 (FIG. 1) may be encoded in one of the frequency ranges 50 or in more than one of the frequency ranges 50 depending upon the encoding criteria chosen by the content provider or the broadcaster, by way of example only. Therefore, the processor 20 (FIG. 1) will check one of the frequency ranges 50 or more than one of the frequency ranges 50 to see if the signal 40 is less than the value v depending upon the encoding criteria. By way of example, the processor 20 may look for sections 38 where the signal 40 is always below value v in the frequency range 50 centered around frequency f/2. Alternatively, the processor 20 may look for sections 38 where the signal 40 is always below value v both in the frequency range 50 centered around frequency f/2 and in the frequency range centered around frequency **2*f* and therefore only those sections 38 where the signal 40 is always below the value v in both the frequency ranges 50** centered around f/2 and 2f will be selected as opportunities.

A discussion now follows regarding selection of the value v.

The user of the rendering device 18 (FIG. 1) may decide to record the audio stream 12 and then playback the audio stream 12 with the watermark data 14 (FIG. 1) encoded therein for outputting to another device in an attempt to erase the watermark data 14 from the audio stream 12. The other device may then re-encode the received audio stream 12. If the encoding of the watermark data 14 is not encoded with a large enough amplitude, the encoding could be masked by the re-encoding of the audio stream 12 by the other device. Therefore, the watermark encoding by the watermark encoder 30 (FIG. 1) needs to be large enough to prevent being masked, but small enough so as not to bother the listener. The inventor suggests encoding the selected opportunities by adding audio with an amplitude equal to approximately a quarter of the fundamental frequency 46 amplitude. However, the exact amplitude of the added audio may depend on which type of listener you don't want to bother as well as the re-encoding algorithms you want to protect against as well as other possible factors.

Another factor to be considered is that the amplitude of the signal 40 in the relevant frequency ranges 50 for a section 38 after encoding the watermark data 14 (FIG. 1) needs to be small enough so that the fundamental frequency 46 of that section is not overwhelmed (which could change the sound too much).

Therefore, in order to decide whether to encode part of the watermark data 14 in a particular section 38 (i.e. is that section 38 an opportunity), the available frequency range(s) 50 for possibly encoding part of the watermark data 14 therein needs to have enough spare amplitude so that more audio can be added for encoding, taking into account the above requirements. The inventor suggests that the value v is typically equal to b/4, where b is the amplitude of the fundamental frequency 46 of that section 38.

The size of each of the different frequency ranges 50 is typically equal to 6% of the frequency 48 at the center of each of the different frequency ranges 50, respectively. So for example, if the harmonic frequency 48 at the center of a frequency range 50 has a frequency of 500 Hz, then the frequency range 50 is 6% of 500 Hz which equals 30 Hz. So the frequency range 50 extends from 470 Hz to 530 Hz. The value 6% is suggested by the inventor as that is typically the step between two adjacent musical notes.

FIG. 2 shows the signal 40 for two of the sections 38 of the audio stream 12, namely, a section 52 and a section 54.

The sections 52, 54 will first be analyzed assuming that the encoding criteria requires that watermark encoding take place around both harmonic frequencies 48, f/2 and 2f and that v equals b/4.

The section 52 shows that the signal 40 has an amplitude of zero in the frequency range 50 centered around frequency f/2 and that the signal 40 in the frequency range 50 centered around frequency **2*f* includes two parts of the signal 40, a part 56 and a part 58. Both parts 56, 58 are below b/4. Therefore, section 52** would be selected as an encoding opportunity.

Regarding the section 54, the signal 40 has an amplitude of zero in the frequency range 50 centered around frequency f/2 and the signal 40 in the frequency range 50 centered around frequency **2*f* includes two parts of the signal 40, a part 60 and a part 62. Part 60 has an amplitude less than b/4 but the part 62 has an amplitude greater than b/4. Therefore, section 52** would not be selected as an encoding opportunity.

If the sections 52, 54 are analyzed assuming that the encoding criteria requires that watermark encoding occurs only in or around the harmonic frequency f/2 and that v equals b/4, both the sections 52, 54 would be selected as encoding opportunities.

For each section 38 defined as an encoding opportunity by the processor 20 (FIG. 1), the processor 20 is typically operative to prepare the information 26 (FIG. 1) identifying the defined opportunities including: timing information of the relevant section 38; the amplitude of the signal 40 at the fundamental frequency 46 of the relevant section 38 (as the amplitude of the audio added to the signal 40 in order to encode part of the watermark data 14 (FIG. 1) may be determined as a fraction of the fundamental frequency 46); and the harmonic frequency or frequencies 48 where encoding will take place in the relevant section 38 or the frequency of the fundamental frequency 46 which will enable calculation of the harmonic frequencies 48.

In accordance with an embodiment of the present invention, encoding of one bit of the watermark data 14 (FIG. 1) is based on two encoding opportunities in which the encoding opportunities are paired. This encoding method is described in more detail with reference to FIG. 5. Therefore, in accordance with this embodiment, the processor 20 (FIG. 1) is operative to prepare the information 26 (FIG. 1) identifying the defined opportunities to include data defining pairs of the sections 38 defined as opportunities for encoding the watermark 14.

Figures 3, 4, 5:
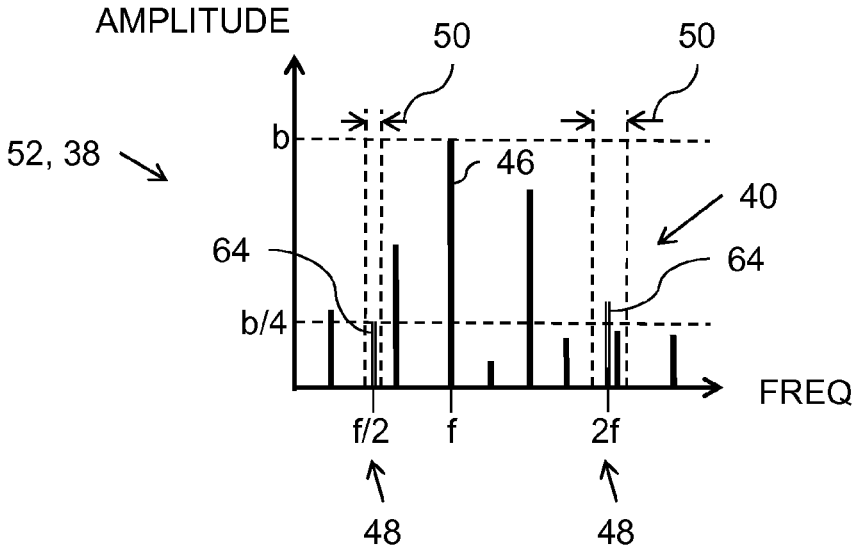
FIG. 3 is a view showing a section after encoding part of a watermark in the system of FIG. 1.
FIG. 4 is a table showing a first encoding method in the system of FIG. 1.
FIG. 5 is a table showing a second encoding method in the system of FIG. 1.

Reference is now made to FIG. 3, which is a view showing the section 52 of FIG. 2 after encoding part of the watermark data 14 (FIG. 1) in the system 10 of FIG. 1.

The watermark encoder 30 (FIG. 1) is typically operative to encode the watermark 14 into the audio stream 12 (FIG. 2) based on the received information 26 (FIG. 1) identifying the defined opportunities. The encoding typically includes adding audio 64 to at least some of the sections 38 defined as the encoding opportunities. The added audio 64 is typically added such that for each section 38 (defined as an opportunity), the added audio 64 is added somewhere in each of the different frequency ranges 50 or in one of the frequency ranges 50 depending on the encoding criteria. Although the added audio 64 may be added anywhere in the selected frequency range(s), the audio 64 is typically added as close to the harmonic frequencies 48 as possible in order to minimize bothering the listener.

For each encoded section 38, the added audio 64 typically has a maximum amplitude equal to 25% of the amplitude of the signal 40 at the fundamental frequency 46 of that section 38.

The audio 64 is typically added by amending the signal 40 for each relevant section 38. In other words the audio 64 is added in the frequency domain, for example, by amending MPEG encoded audio data for each audio frame.

If the rendering device 18 (FIG. 1) doesn't have access to the data of the audio stream 12 (FIG. 2) in the frequency domain, then the rendering devices 18 can create a sound at a certain frequency at a certain time based on the information 26 (FIG. 1) identifying the defined opportunities.

Reference is now made to FIG. 4, which is a table showing a first encoding method in the system 10 of FIG. 1. Reference is also made to FIG. 3.

The watermark data 14 may be represented as a bit stream, a series of "0"s and "1"s. Each bit in the bit stream is typically encoded in a different section 38 selected as an encoding opportunity.

FIG. 4 shows twelve sections 38. Of the twelve sections, sections 1, 4-6, 10 and 12 are defined as encoding opportunities.

A "1" is encoded by adding the audio 64 at the harmonic frequency or frequencies 48 (depending upon the encoding criteria, for example at frequency f/2 and/or 2f) in one of the sections 38. A "0" is encoded by not adding the audio 64 in one of the sections 38. In this way, the various "1"s and "0"s may be encoded in the encoding opportunities.

So for sections 1, 5, 6, and 12 a "1" is encoded by adding the audio 64 (FIG. 3). For sections 4 and 10, a "0" is encoded by not adding audio.

This encoding method could lead to errors whereby what appears to be a "0" is in fact an encoding error, such as a "1" incorrectly encoded or a skip.

Additionally, it is generally not possible to randomly skip opportunities because it may be impossible or very difficult to know if it is simply a skipped opportunity or if it is a zero, unless skipped opportunities are part of the encoding method.

Reference is now made to FIG. 5, which is a table showing a second encoding method in the system 10 of FIG. 1. Reference is also made to FIG. 3.

FIG. 5 shows twelve sections 38. Of the twelve sections 38, section 1, 4-6, 8-10 and 12 are defined as encoding opportunities.

Additionally, the opportunities are paired for encoding purposes.

FIG. 5 shows sections 1 and 4 forming a pair, sections 5 and 6 forming a pair, sections 8 and 9 forming a pair, and sections 10 and 12 forming a pair.

A "1" is encoded by adding the audio 64 at the harmonic frequency or frequencies 48 (depending upon the encoding criteria, for example at frequency f/2 and/or 2f) in the first section 38 of a pair of the sections 38.

A "0" is encoded by adding the audio 64 at the harmonic frequency or frequencies 48 (depending upon the encoding criteria, for example at frequency f/2 and/or 2f) in the second section 38 of a pair of the sections 38.

So audio 64 is added in section 1 and not in section 4 in order to encode a "1". Audio 64 is added in section 9 and not in section 8 in order to encode a "0".

Audio 64 has been added to both sections 5 and 6. Therefore, the encoding of the pair including sections 5 and 6 is invalid. Audio 64 has not been added to either sections 10 and 12. Therefore, the encoding of the pair including sections 10 and 12 was skipped.

In order to prevent detection of the watermark data 14 embedded in the audio stream 12, a sophisticated hacker might decide to increase or decrease the audio frequency by an octave or more. This change can still be detected using logarithms. If the original frequency is F and the hacked frequency is m×F (m depends on how many octaves the audio has been shifted by), then log (mF) is mathematically equivalent of log m plus log F. The original signal is shifted by a certain number and so the hack can be detected.

In practice, some or all of these functions may be combined in a single physical component or, alternatively, implemented using multiple physical components. These physical components may comprise hard-wired or programmable devices, or a combination of the two. In some embodiments, at least some of the functions of the processing circuitry may be carried out by a programmable processor under the control of suitable software. This software may be downloaded to device 26 in electronic form, over a network, for example. Alternatively or additionally, the software may be stored in tangible, non-transitory computer-readable storage media, such as optical, magnetic, or electronic memory.

It is appreciated that software components of the present invention may, if desired, be implemented in ROM (read only memory) form. The software components may, generally, be implemented in hardware, if desired, using conventional techniques. It is further appreciated that the software components may be instantiated, for example, as a computer program product; on a tangible medium; or as a signal interpretable by an appropriate computer.

It will be appreciated that various features of the invention which are, for clarity, described in the contexts of separate embodiments may also be provided in combination in a single embodiment. Conversely, various features of the invention which are, for brevity, described in the context of a single embodiment may also be provided separately or in any suitable sub-combination.

It will be appreciated by persons skilled in the art that the present invention is not limited by what has been particularly shown and described hereinabove. Rather the scope of the invention is defined by the appended claims and equivalents thereof.

What is claimed is:

1. A system, comprising a processor to define a plurality of opportunities for encoding a watermark into an audio stream, the audio stream having a plurality of sections, each of the sections, when represented in the frequency domain, including a signal of amplitude against frequency, the processor being operative to, for each one of the sections of the audio stream:

identify a fundamental frequency, f, of the one section, the fundamental frequency being the frequency with the largest amplitude of the signal in the one section, the fundamental frequency f defining a plurality of harmonic frequencies, each of the harmonic frequencies being at a frequency f/2n or 2fn, n being a positive integer; and define the one section as an opportunity for encoding at least part of the watermark if the amplitude of the signal of the one section is less than a value v for all frequencies in one or more of a plurality of different frequency ranges, each of the different frequency ranges being centered around different ones of the harmonic frequencies.

2. The system according to claim 1, wherein the value v is less than, or equal to, 25% of the amplitude of the signal at the fundamental frequency of the one section.

3. The system according to claim 1, wherein the size of each of the different frequency ranges is equal to 6% of the frequency at the center of each of the different frequency ranges, respectively.

4. The system according to claim 1, wherein the harmonic frequencies are within a range of frequencies from 20 Hertz to 20,000 Hertz.

5. The system according to claim 1, wherein the processor is operative to prepare data for transmission to another device, the data including: the audio stream formatted in the frequency domain or in the time domain; and information identifying the defined opportunities.

6. The system according to claim 5, further comprising transmission equipment to transmit the data to the other device.

7. The system according to claim 5, wherein the processor is operative to prepare the data to include, for each one of the sections of the audio stream defined as one of the opportunities: timing information of the one section; the amplitude of the signal at the fundamental frequency of the one section; the one or more different ones of the harmonic frequencies of the one section.

8. The system according to claim 5, wherein the processor is operative to prepare the data to include data defining pairs of the sections which have been defined as one of the opportunities for encoding the watermark.

9. The system according to claim 1, further comprising a watermark encoder to encode the watermark into the audio stream, the encoding including adding audio to at least some of the sections defined as the encoding opportunities, the added audio being added such that for each one of the defined sections, the added audio is added somewhere in: each of the different frequency ranges; or in one of the different frequency ranges.

10. The system according to claim 9, wherein the added audio has a maximum amplitude equal to 25% of the amplitude of the signal at the fundamental frequency of the one section.

11. A method, comprising:

defining a plurality of opportunities for encoding a watermark into an audio stream, the audio stream having a plurality of sections, each of the sections, when represented in the frequency domain, including a signal of amplitude against frequency; and for each one of the sections of the audio stream:

identifying a fundamental frequency, f, of the one section, the fundamental frequency being the frequency with the largest amplitude of the signal in the one section, the fundamental frequency f defining a plurality of harmonic frequencies, each of the harmonic frequencies being at a frequency f/2n or 2fn, n being a positive integer; and defining the one section as an opportunity for encoding at least part of the watermark if the amplitude of the signal of the one section is less than a value v for all frequencies in one or more of a plurality of different frequency ranges, each of the different frequency ranges being centered around different ones of the harmonic frequencies.

* * * * *